US010185240B2

(12) United States Patent
Ai et al.

(10) Patent No.: US 10,185,240 B2
(45) Date of Patent: Jan. 22, 2019

(54) IMAGE FORMING APPARATUS WITH STORAGE OF CLEANING BLADE CONTACT PRESSURE

(71) Applicant: CANON KABUSHIKI KAISHA, Tokyo (JP)

(72) Inventors: Ryuta Ai, Tokyo (JP); Takashi Ueno, Tokyo (JP); Masahiro Makino, Tsukubamirai (JP); Yuichi Hatanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/653,888

(22) Filed: Jul. 19, 2017

(65) Prior Publication Data

US 2018/0039199 A1 Feb. 8, 2018

(30) Foreign Application Priority Data

Aug. 2, 2016 (JP) ..... 2016-151874
Aug. 30, 2016 (JP) ..... 2016-168554

(51) Int. Cl.
*G03G 15/02* (2006.01)
*G03G 15/16* (2006.01)
(Continued)

(52) U.S. Cl.
CPC ..... *G03G 15/0225* (2013.01); *G03G 15/0258* (2013.01); *G03G 15/168* (2013.01);
(Continued)

(58) Field of Classification Search
CPC ..... G03G 15/0225; G03G 15/168; G03G 15/161; G03G 2215/1647; G03G 2215/1661; G03G 21/0011
See application file for complete search history.

(56) References Cited

U.S. PATENT DOCUMENTS 5,200,779 A * 4/1993 Nawata ..... G03G 15/553 399/24
7,251,433 B2 7/2007 Ai et al.
(Continued)

FOREIGN PATENT DOCUMENTS

EP 2 827 199 A1 1/2015
JP 05-040438 * 2/1993
(Continued)

OTHER PUBLICATIONS

Search Report dated Nov. 23, 2017, in European Patent Application No. 17182513.6.

*Primary Examiner* — Sandra Brase
(74) *Attorney, Agent, or Firm* — Venable LLP

(57) ABSTRACT

An image forming apparatus includes an image bearing member, a transfer member, a cleaning blade, an information storing member configured to store information on contact pressures of the cleaning blade to the image bearing member, an information input portion, and an executing portion configured to execute a toner supplying operation for supplying toner to the cleaning portion using a toner image formed on the image bearing member, in a period other than a period in which the toner image is formed on the image bearing member, for each predetermined number of image forming operations. On the basis of the information inputted to the input portion, the executing portion sets amounts of the toner supplied to the respective regions in the toner supplying operation.

16 Claims, 13 Drawing Sheets

(51) Int. Cl.
*G03G 15/00* (2006.01)
*G03G 21/00* (2006.01)
*G03G 21/18* (2006.01)

(52) U.S. Cl.
CPC ..... *G03G 15/553* (2013.01); *G03G 15/556* (2013.01); *G03G 21/0011* (2013.01); *G03G 21/0094* (2013.01); *G03G 15/161* (2013.01); *G03G 15/5016* (2013.01); *G03G 21/1814* (2013.01); *G03G 2215/1652* (2013.01); *G03G 2215/1661* (2013.01)

(56) References Cited

U.S. PATENT DOCUMENTS 7,764,917 B2 7/2010 Ueno
8,095,032 B2 1/2012 Torimaru et al.
8,135,303 B2 3/2012 Ai et al.
8,224,199 B2 7/2012 Ai
9,075,371 B2 7/2015 Ueno
9,201,379 B2 12/2015 Yuasa
2007/0127935 A1* 6/2007 Inami ..... G03G 15/065 399/12
2007/0201897 A1* 8/2007 Maeda ..... G03G 15/161 399/101
2013/0156455 A1* 6/2013 Kakehi ..... G03G 15/18 399/66
2014/0340457 A1 11/2014 Hashimoto
2015/0023682 A1* 1/2015 Yuasa ..... G03G 21/0094 399/71
2016/0342113 A1* 11/2016 Sakurai ..... G03G 15/161
2017/0115608 A1 4/2017 Ueno et al.
2017/0227907 A1 8/2017 Makino et al.

FOREIGN PATENT DOCUMENTS

JP H05-40438 A 2/1993
JP H11-194557 A 7/1999
JP 2000-172026 A 6/2000
JP 2005-250215 * 9/2005
JP 2005-250215 A 9/2005
JP 2007-030385 A 2/2007
JP 2007-328175 A 12/2007
JP 2009-103739 * 5/2009
JP 2009-103739 A 5/2009
JP 2010-217766 * 9/2010
JP 2010-217766 A 9/2010
JP 2015-022189 A 2/2015
JP 2015-232586 A 12/2015

* cited by examiner

IMAGE FORMING APPARATUS WITH STORAGE OF CLEANING BLADE CONTACT PRESSURE

FIELD OF THE INVENTION AND RELATED ART

The present invention relates to an image forming apparatus, such as a copying machine, a printer, a facsimile machine or a multifunction machine having functions of these machines, of an electrophotographic type or an electrostatic recording type.

In the image forming apparatus of the electrophotographic type or the like, there is a need that after a toner image is transferred from an image bearing member such as a photosensitive member onto a toner image receiving material, toner (transfer residual toner) remaining on the image bearing member is removed. For that purpose, a cleaning member provided in contact with a surface of the image bearing member has been used. As the cleaning member, a cleaning blade (hereinafter, simply referred to as a "blade") formed with an elastic member such as polyurethane rubber has been widely used.

The blade is disposed in contact with the image bearing member counterdirectionally to a movement direction of the image bearing member. For that reason, a frictional force between the image bearing member and the blade is excessive in some instances. When this frictional force is excessive, chipping of an edge of the blade and turning-up of the edge of the blade such that the blade is reversed in the movement direction occurs in some cases. The toner and an external additive have an effect of maintaining a lubricating property between the blade and the image bearing member, but when the toner and the external additive interposed at a contact portion between the image bearing member and the blade decrease in amount, the chipping and turning-up of the blade are liable to occur. When the chipping and turning-up of the blade occur, power of scraping off the toner from the image bearing member by the blade lowers, so that improper cleaning occur in some instances.

Therefore, in Japanese Laid-Open Patent Application (JP-A) 2007-328175, a method in which a band-like toner image (hereinafter, also referred to as a "toner band") is formed on the image bearing member during non-image formation and is supplied to a contact portion (blade nip) between the image bearing member and the blade has been known. By supplying the toner to the blade nip, the frictional force between the image bearing member and the blade is reduced by the toner and the external additive, so that the chipping and turning-up of the blade can be suppressed.

However, in the method disclosed in JP-A 2007-328175, a density (a toner weight per unit area) of the toner band and a length (width) of the toner band with respect to the movement direction of the image bearing member are uniform with respect to a longitudinal direction of the blade, and therefore it turned out that there is the following problem.

That is, the chipping and turning-up of the blade depends on contact pressure (force per unit length of the blade with respect to the longitudinal direction) of the blade to the image bearing member. In the case where the contact pressure is relatively high, the frictional force between the blade and the image bearing member increases, so that there is a tendency that a degree of progress of the chipping of the blade becomes fast and that also the turning-up of the blade is liable to generate. As regards the contact pressure, for the reason such as a contact type of the blade and a variation in parts, in general, there is a variation depending on a longitudinal position of the blade, i.e., a pressure distribution with respect to the longitudinal direction of the blade. For that reason, the chipping of the blade progresses from a portion where the contact pressure is relatively high and the turning-up of the blade is liable to generate from the portion, so that there is a need to exchange the parts and thus a lifetime of a unit including the blade is shortened in some cases.

In order to solve this problem, in the conventional method, a toner band having a uniform density and a uniform width with respect to the longitudinal direction of the blade is formed. For that reason, there is a possibility that a toner amount of the toner band is insufficient at the portion where the contact pressure is relatively high, and on the other hand, at a portion where the contact pressure is relatively low, the toner amount of the toner band is excessive, so that the toner is consumed uselessly.

SUMMARY OF THE INVENTION

According to an aspect of the present invention, there is provided an image forming apparatus comprising: an image bearing member configured to bear a toner image; a transfer member configured to transfer the toner image from the image bearing member onto a toner image receiving member at a transfer portion; a cleaning blade contacting the image bearing member at a cleaning portion and configured to remove a deposited matter on the image bearing member with movement of the image bearing member; an information storing member configured to store information on contact pressures which are contact forces per unit length of the cleaning blade to the image bearing member with respect to a widthwise direction perpendicular to a movement direction of the image bearing member in each of a plurality of regions of the cleaning blade with respect to the widthwise direction; an input portion to which the information stored in the information storing member is inputted; and an executing portion configured to execute a toner supplying operation for supplying toner to the cleaning portion using a toner image formed on the image bearing member, in a period other than a period in which the toner image is formed on the image bearing member, for each predetermined number of image forming operations, wherein on the basis of the information inputted to the input portion, the executing portion sets amounts of the toner supplied to the respective regions in the toner supplying operation.

Further features of the present invention will become apparent from the following description of exemplary embodiments with reference to the attached drawings.

DESCRIPTION OF EMBODIMENTS

An image forming apparatus according to the present invention will be described with reference to the drawings.

Embodiment 1

1. General Constitution and Operation of Image Forming Apparatus

Figure 1:
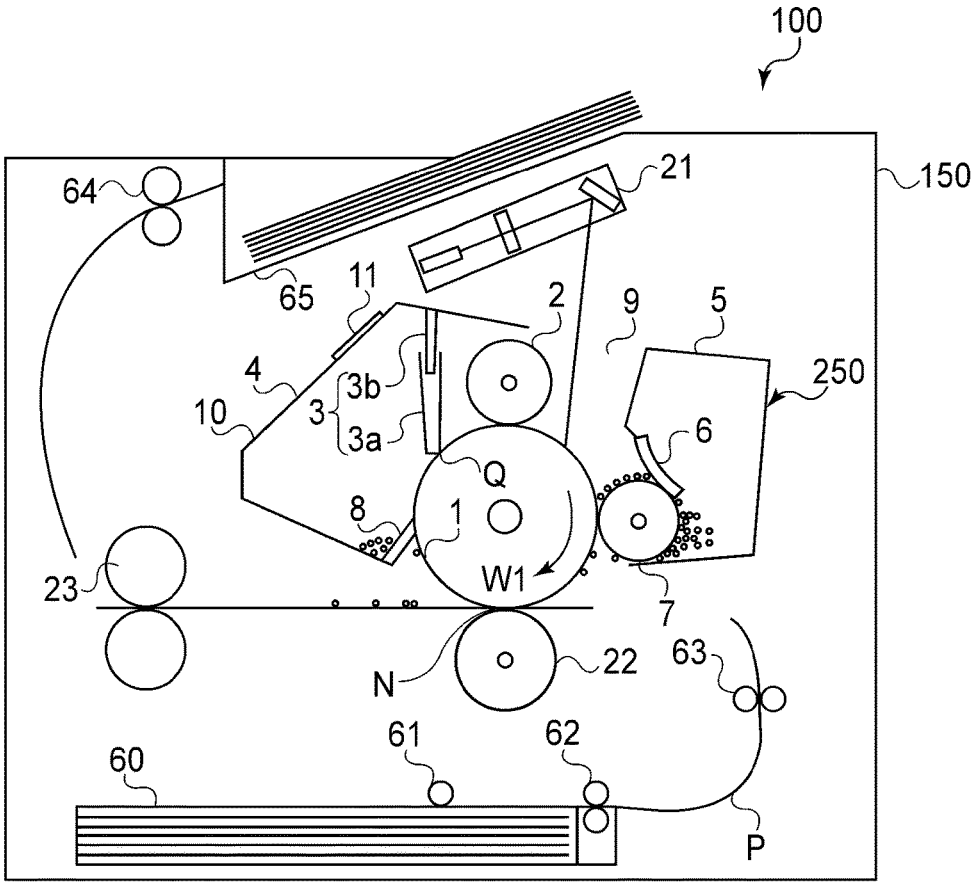
FIG. 1 is a schematic sectional view of an image forming apparatus.

FIG. 1 is a schematic sectional view of an image forming apparatus 100 in this embodiment according to the present invention.

The image forming apparatus 100 in this embodiment is a laser printer which forms an image by using an electrophotographic type and to which a process cartridge 250 is detachably mountable.

A photosensitive drum 1 which is a drum-shaped rotatable electrophotographic photosensitive member as an image bearing member for bearing a toner image is rotationally driven in an arrow W1 direction (clockwise direction) in FIG. 1 at a predetermined peripheral speed (process speed) by a driving motor (not shown) as a driving source. In this embodiment, the photosensitive drum 1 is a negatively chargeable organic photosensitive member. A surface of the rotating photosensitive drum 1 is electrically charged uniformly to a predetermined polarity (negative in this embodiment) and a predetermined potential by a charging roller 2 as a charging member. The charging roller 2 is provided in contact with the photosensitive drum 1 and is rotated by rotation of the photosensitive drum 1. During a charging step, to the charging roller 2, a predetermined charging bias is applied from a charging bias voltage source (not shown).

The surface of the charged photosensitive drum 1 is exposed to light by an exposure device 21. In this embodiment, the exposure device 21 is a semiconductor laser scanner and outputs laser light modulated corresponding to an image signal sent from an external device (such as a personal computer) connected communicatably with the image forming apparatus 1. The exposure device 21 subjects the surface of the photosensitive drum 1 to scanning exposure (first wise exposure) to light through an exposure window portion 9 of the process cartridge 250. Then, an absolute value of a potential of the surface of the photosensitive drum 1 at an exposed portion becomes lower than an absolute value of a charge potential formed by the charging roller 2, so that an electrostatic latent image (electrostatic image) is formed on the photosensitive drum 1.

The electrostatic image formed on the photosensitive drum 1 is developed (visualized) with toner as a developer by a developing device 5, so that the toner image is formed on the photosensitive drum 1. In this embodiment, as a developing type, a jumping development type and a reverse development type are employed. That is, a superposed developing bias consisting of an AC component and a DC component is applied from a developing bias voltage source (not shown) to a developing roller 7. Then, the toner negatively charged at a contact portion between a developer layer thickness regulating member 6 and the developing roller 7 is deposited on the photosensitive drum 1 at an image portion (exposed portion) of the electrostatic latent image.

The toner image formed on the photosensitive drum 1 is electrostatically transferred onto a recording material (recording medium, transfer material, sheet) such as paper which is a toner image receiving member by a transfer roller 22 as a transfer member. The transfer roller 22 is pressed (urged) by an urging spring (not shown) in a direction toward a rotation center of the photosensitive drum 1, so that a transfer portion N where the photosensitive drum 1 and the transfer roller 22 contact each other. During a primary transfer step, to the transfer roller 22, a transfer bias which is a DC voltage of an opposite polarity (positive in this embodiment) to the charge polarity (normal charge polarity) of the toner during the development is applied from a transfer bias voltage source (not shown). The recording material is stacked and accommodated in an accommodating cassette 60. At predetermined control timing, the recording material P is separated and fed one by one from the accommodating cassette 60 and is fed to a registration roller pair 63 by rotationally driving a pick-up roller 61 and a feeding roller 62. Then, the recording material P is supplied to the transfer portion N while being timed to the toner image on the photosensitive drum 1 by the registration roller pair 63.

The recording material P on which the toner image is transferred is separated from the photosensitive drum 1 and is fed to a fixing device 23. In the fixing device 23, the toner image transferred on the recording material P is fixed (melt-fixed) heat and pressure. The recording material P on which the toner image is fixed is discharged (outputted) by a discharging roller 64 onto a discharge tray 65 provided outside of an apparatus main assembly 150 of the image forming apparatus 100.

On the other hand, the surface of the photosensitive drum 1 after the transfer of the toner image onto the recording material P is cleaned by a cleaning device 4 as a cleaning member. The chipping device 4 includes a cleaning portion 3 provided with a blade 3*a* as a cleaning member and a supporting member 3*b* which supports the blade 3*a* and which is formed of a metal plate. The cleaning device 4 removes, from the surface of the rotating photosensitive drum 1, the toner (transfer residual toner) which cannot be completely transferred from the photosensitive drum 1 onto the recording material P during the transfer step, and collects the toner in a collecting container 10. The blade 3*a* is a plate-like (blade-like) member having a predetermined length with respect to each of a longitudinal direction substantially parallel to a rotational axis direction of the photosensitive drum 1 and of a widthwise direction substantially perpendicular to the longitudinal direction. The blade 3*a* is disposed in contact with the photosensitive drum 1 with a predetermined angle so that the blade 3*a* extends counterdirectionally to the rotational direction of the photosensitive drum 1 (i.e., so that a free end of the blade 3*a* faces toward an upstream side of the rotational direction of the photosensitive drum 1). The blade 3*a* contacts the photosensitive drum 1 in a predetermined range including an edge of a free end thereof with respect to the widthwise direction. In this embodiment, a longitudinal length of the blade 3*a* is 340 mm and is longer than an image forming region on the photosensitive drum 1 (i.e., the image forming region falls within the longitudinal length range of the blade 3*a*). The image forming region is a region where the toner image is formable with respect to a direction substantially perpendicular to a movement direction of the surface of the photosensitive drum 1.

In this embodiment, the photosensitive drum 1, and as means actable on the photosensitive drum 1, the charging roller 2, the developing device 5 and the cleaning device 4 integrally constitute a process cartridge 250 which is a unit detachably mountable the apparatus main assembly 150.

In this embodiment, operations of the respective portions of the image forming apparatus 100 are controlled by a CPU 103 (FIG. 7) as a controller provided in the apparatus main assembly 150. The CPU 103 carries out integrated control of the operations of the respective portions of the image forming apparatus 100 in accordance with a program stored in a main assembly storing portion 101 constituted by including a ROM and the like.

The image forming apparatus 100 executes a series of operations (job, printing operation), started by a single start instruction, for forming and outputting the image(s) on a single recording material P or a plurality of recording materials. The job generally includes an image forming step, a pre-rotation step, a sheet interval step in the case where the images are formed on a plurality of recording materials P, and a post-rotation step. The image forming step is performed in a period in which formation of the electrostatic latent image for the image to be actually formed on the recording material P and then to be outputted, formation of the toner image and transfer of the toner image are carried out, and during image formation refers to this period. Specifically, timing during the image formation is different among executing positions of the electrostatic latent image formation, the toner image formation and the toner image transfer. The pre-rotation step is performed in a period in which a preparatory operation, before the image forming step, from an input of the start instruction until the image is actually started to be formed. The sheet interval step is performed in a period corresponding to an interval between a recording material P and a subsequent recording material P when the images are continuously formed on the plurality of recording materials P (continuous image formation). The post-rotation step is performed in a period of a post-operation (preparatory operation) after the image forming step. A non-image formation period is a period other than during image formation and includes the above-described periods of the pre-rotation step, the interval step and the post-rotation step, and further includes a period during main switch actuation of the image forming apparatus 100, a period during a pre-multi-rotation step for performing a preparatory operation during restoration from a sleep state, and the like. A supplying operation for supplying the toner to a contact portion between the photosensitive drum 1 and the blade 3*a* described later is executed during non-image formation.

2. Blade Manufacturing Method

Figure 2:
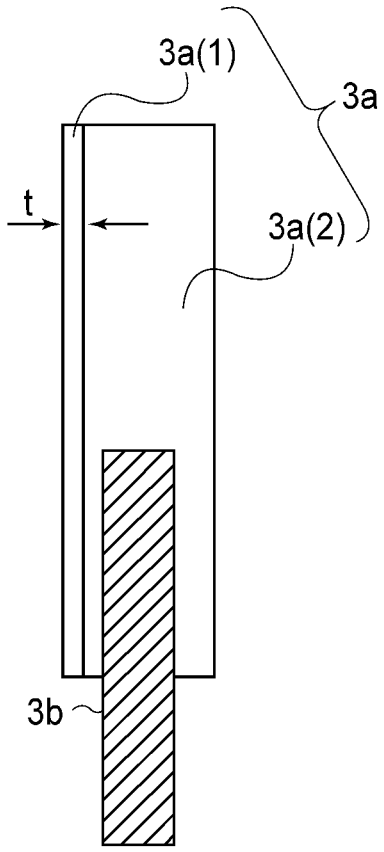
FIG. 2 is a schematic sectional view of a blade.

A manufacturing method of the blade 3*a* in this embodiment will be described with reference to FIG. 2. FIG. 2 is a schematic sectional view of the blade 3*a* in this embodiment.

In this embodiment, the blade 3*a* has a two-layer structure including an edge layer 3*a*(1) containing an edge contacting the photosensitive drum 1, a base layer 3*a*(2) provided in a side opposite from the photosensitive drum 1 with respect to the edge layer 3*a*(1). Each of the edge layer 3*a*(1) and the base layer 3*a*(2) is formed of a polyurethane resin material manufactured using a polyisocyanate compound and a multi-functional active hydrogen compound.

As a molding method of the blade 3*a* formed of the polyurethane resin material, the following method can be used. A polymeric polyol, polyisocyanate, a cross-linking agent, a catalyst and the like are mixed with each other at one time, and are poured into a metal mold, followed by molding. At that time, the blade 3*a* formed of the polyurethane resin material is directly molded on a supporting member 3*b*. Then, in order to prepare the contact portion with the photosensitive drum 1 with accuracy, a free end portion of the blade 3*a* formed of the polyurethane resin material is cut. The blade 3*a* may also be fixed to the supporting member 3*b* by bonding or the like.

As a method of forming the edge layer 3*a*(1) and the base layer 3*a*(2), roughly, it is possible to use a method (JP-A 2007-30385) of continuously molding a blade material by using a rotatable molding drum with grooves formed at an outer periphery of the drum.

In this embodiment, an entire thickness of the blade 3*a* is 2 mm. At this time, a thickness of the edge layer 3*a*(1) may desirably be 100-300 μm. In this embodiment, the edge layer 3*a*(1) is 77° in hardness (JIS-A) and 10% in impact resilience, and the base layer 3*a*(2) is 77° in hardness (JIS-A) and 45% in impact resilience.

By using a low-impact resilience material for the edge layer 3*a*(1), a removing effect of a deposited matter on the photosensitive drum 1 in repetitive use is improved. On the surface of the photosensitive drum 1, the deposited matter is deposited due to filming of the external additive added to the toner, fusion of the toner by melting, and the like. By using the low-impact resilience material for the edge layer 3*a*(1), the edge of the blade 3*a* is not readily deformed when the edge of the blade 3*a* contacts the deposited matter, so that the removing effect of the deposited matter is improved. On the other hand, by using a high-impact resilience material for the base layer 3*a*(2), the blade 3*a* can achieve an original elasticity effect thereof. That is, a stable contact state can be maintained against also a change in contact state, such as an increase in frictional force of the surface of the photosensitive drum 1 by repetitive use, so that it is possible to reduce generation of noise such as shuddering, judder or the like.

3. Chipping of Blade

A relationship between a contact pressure of the blade 3*a* to the photosensitive drum 1 (i.e., a force per unit length of the blade with respect to the longitudinal direction, hereinafter also referred to as a "blade pressure") and a degree of generation of chipping of the blade 3*a* will be described. Incidentally, as regards the image forming apparatus 100 and elements thereof, a front side on the drawing sheet refers to a "front side", and a rear side on the drawing sheet refers to a "rear side". A depth direction connecting the "front side" and the "rear side" is substantially parallel to the rotational axis direction of the photosensitive drum 1.

An inconvenience due to an excessive frictional force between the photosensitive drum 1 and the blade 3*a* at the contact portion (blade nip) Q between the blade 3*a* and the photosensitive drum 1 is not limited to the chipping of the blade 3*a* but may also include turning-up, generation of the noise and the like. However, description in this embodiment will be made by paying attention to the chipping of the blade 3*a* which particularly causes generation of improper cleaning and which leads to exchange of the unit including the blade 3*a*. Also a degree of generation of an inconvenience other than the chipping of the blade 3*a* is correlated with the frictional force between the photosensitive drum 1 and the blade 3*a*, and therefore, is correlated with the degree of the generation of the blade 3*a*.

In order to check the degree of the generation of the chipping of the blade 3*a*, a durability test for repetitively outputting the image was conducted using the image forming apparatus 100 having the constitution in this embodiment. This test was conducted after installing the image forming apparatus 100 in a high-temperature and high-humidity environment of 30° C. and 80% RH in order to accelerate the chipping of the blade 3*a*. As the image to be outputted, a so-called solid white image of 0% in print ratio was used, and thus a condition in which the toner did not readily reach the blade nip Q was employed. The number of image output sheets was 100,000 sheets and the images were outputted on 100,000 sheets and thereafter the edge of the blade 3*a* was observed through an optical microscope, so that the degree of the generation of the chipping of the blade 3*a* was converted into numbers (numerals). The blade pressure was measured at three points of the blade 3*a* with respect to the longitudinal direction, i.e., a position ("F") of 50 mm from a front-side end toward a central side, a position ("roller") of 50 mm from a rear-side end toward the central side, and a center ("C"), with respect to the longitudinal direction of the blade 3*a*. Further, in order to check dependency of the chipping of the blade 3*a* on the blade pressure, the test was conducted after changing a total blade pressure to two levels (standards) by changing a load of a spring (not shown) pressing the blade 3*a* in a direction contacting the photosensitive drum 1. As the spring, a spring A of 50 gf/cm in spring constant and a spring B of 75 gf/cm in spring constant were used. Table 1 appearing hereinafter shows the blade pressure in the case where each of the springs A and B was used.

The blade pressure was measured using a measuring jig. In this measuring jig, three cylindrical phantom drums each corresponding to the photosensitive drum 1 are disposed in the longitudinal direction with predetermined intervals. With these phantom drums, a load cell for measuring an applied load is connected. Then, the blade 3*a* in an assembly of the process cartridge 250 supported by the supporting member is pressed against the phantom drums, and the load applied by the blade 3*a* is detected by the load cell. As a result, the contact pressure of the blade 3*a* to each of the phantom drums, i.e., the blade pressure of the blade 3*a* in each of the three regions of the blade nip Q, i.e., the front-side position, the center and the rear-side position, with respect to the longitudinal direction of the blade 3*a* can be measured. In this embodiment, as the blade pressure, a linear pressure (gf/cm) in which a value of a load (gf) measured by the load cell is represented as a pressure per unit length of the blade 3*a* is used. However, the value of the load measured by the load cell may also be used as-is. Further, the degree of the generation of the chipping of the blade 3*a* was converted into numbers by using, as a chipping amount (μm), the sum of sizes (lengths with respect to a long-axis direction) of the generated chippings.

TABLE 1

| | F50*1 | C*2 | R50*3 |
|---|---|---|---|
| Spring A | 20 gf/cm | 15 gf/cm | 20 gf/cm |
| Spring B | 20 gf/cm | 25 gf/cm | 20 gf/cm |

*1"F50" is the position of 50 mm from the front-side end.
*2"C" is the contact.
*3"R50" is the position of 50 mm from the rear-side end.

From Table 1, it is understood that there is a tendency that a variation in blade pressure distribution is larger in the case of using the spring A than in the case of using the spring B. This is because the spring pressure increases and flexure generates in the blade 3*a* and exerts stress on a container for holding the blade 3*a*, and therefore, non-uniformity of the blade pressure distribution with respect to the longitudinal direction of the blade 3*a* is liable to generate. In this embodiment, in order to check the dependency of the blade 3*a* on the blade pressure, the durability test was conducted using the spring A and the spring B, but the spring B is used in the image forming apparatus 100 in this embodiment.

Figure 3:
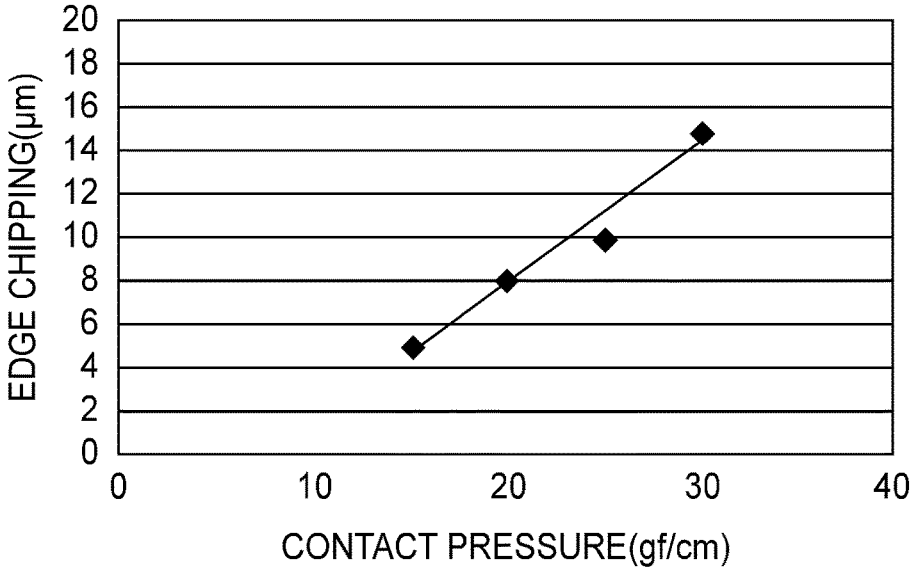
FIG. 3 is a graph showing a relationship between blade pressure and a blade chipping amount.

FIG. 3 shows a relationship between the blade pressure acquired by the above-described durability test and the chipping amount of the blade 3*a*. From FIG. 3, it is understood that a proportional relationship is established between the blade pressure and the chipping amount of the blade 3*a*. This is because a frictional force between the photosensitive drum 1 and the blade 3*a* increases with an increasing blade pressure, and therefore, a deformation amount of the edge of the blade 3*a* increases and thus a stress exerted on the blade 3*a* increases.

A relationship between a supplied toner amount and the chipping amount of the blade 3*a* in the case where a supplying operation for supplying the toner to the blade nip Q in order to reduce the frictional force blade the photosensitive drum 1 and the blade 3*a* is carried out will be described.

As described above, in order to reduce the frictional force between the photosensitive drum 1 and the blade 3*a* at the blade nip Q, a method of supplying the toner to the blade nip Q has been known.

Specifically, during non-image formation, a long band-like toner image for supply (toner band) is formed on the photosensitive drum 1 with respect to the longitudinal direction of the blade 3*a*. Then, the toner of the toner band is supplied to the blade nip Q without being transferred onto the recording material P. As a result, the toner of the toner band and its external additive exist between the photosensitive drum 1 and the blade 3*a* and act as a lubricant, so that the frictional force between the photosensitive drum 1 and the blade 3*a* is lowered and thus the stress exerted on the blade 3*a* can be alleviated.

In order to check a degree of generation of the chipping of the blade 3*a* in the case where the toner band is formed, by using the image forming apparatus 100 in this embodiment, the durability test in which the image was repetitively outputted and the toner band was formed at a predetermined frequency was carried out. In this embodiment, the toner band of 340 in longitudinal length of the blade 3*a* (i.e., length extending over an entire longitudinal length range of the blade 3*a*) was formed once for each image output of 100 sheets and then was supplied to the blade nip Q. A width (length with respect to the rotational direction of the photosensitive drum 1) of the toner band was 100 mm and 20 mm, i.e., two levels. When the toner band passed through the transfer portion N, the transfer bias applied to the transfer roller 22 was in an off state. As a result, transfer of the toner of the toner band onto the transfer roller 22 is suppressed, so that the amount of the toner reaching the blade nip Q can be increased. Setting of the springs A and B, the number of image output sheets, an output image, a test environment and the like are the same as those in the durability test by which the result of FIG. 3 was acquired. The blade pressure distributions of the blade 3*a* with respect to the longitudinal direction in the case where the springs A and B were used in the image forming apparatus 100 were the same as those shown in Table 1.

Figure 4:
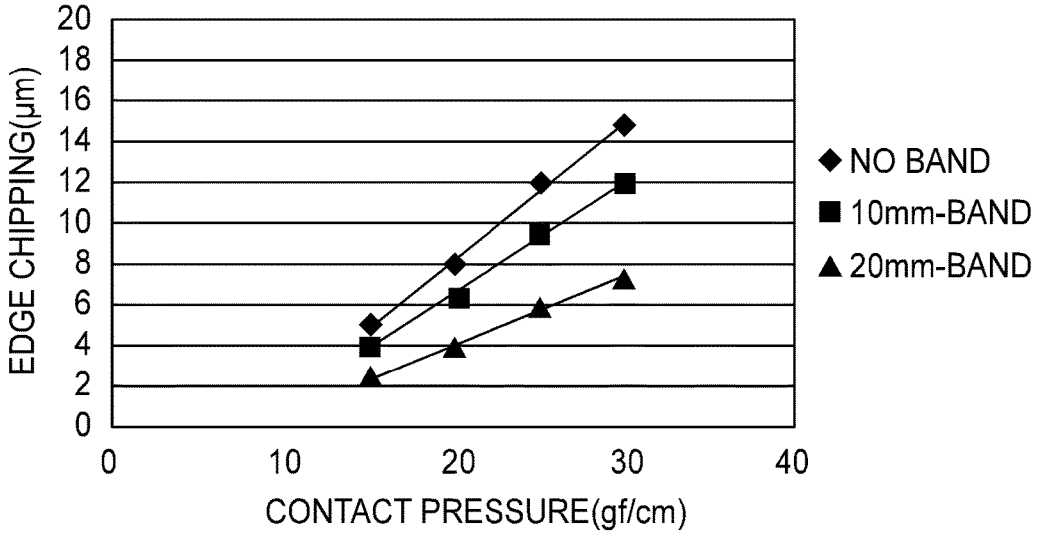
FIG. 4 is a graph showing a relationship between the blade pressure and the blade chipping amount for each of toner amounts of a toner band.
Figure 5:
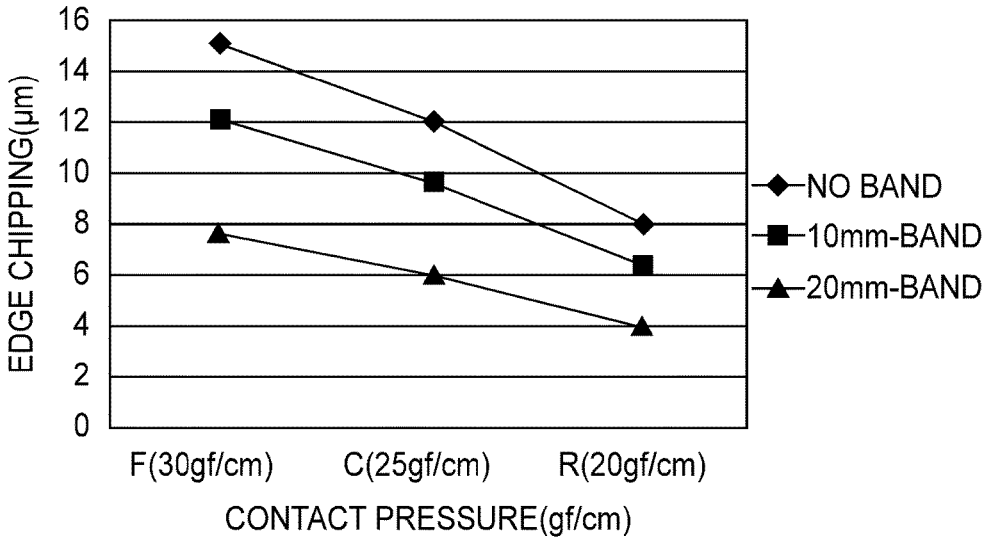
FIG. 5 is a graph for illustrating a degree of generation of blade chipping for each of longitudinal position of the blade.

FIG. 4 shows a relationship, between the blade pressure for each toner band width and the chipping amount of the blade 3*a*, acquired by the above-described durability test in which the toner band is formed. From the figure, it is understood that the chipping amount of the blade 3*a* decreases with an increasing width of the toner band. FIG. 5 is a plot of a relationship, for each of the toner band widths, between the blade pressure with respect to the longitudinal direction of the blade 3*a* and the chipping amount of the blade 3*a* in the case where the spring B is used (i.e., the constitution of this embodiment). In this embodiment, in order to enable use of the blade 3*a* for a sufficiently long term, it is desired that the chipping amount of the blade 3*a* in the above-described durability test is 8 μm or less.

From FIG. 5, it is understood that in order to enable use of the blade 3*a* for a sufficiently long term, the toner band with the width of 20 mm may desirably be formed at a frequency (the number of times of formation of the toner band supplied per predetermined number of times of image formation (per predetermined number of image forming operations)) of once per 100 sheets as the number of times of image formation. This is because the chipping amount of the blade 3*a* in the front side and in the center side, of the blade 3*a* with respect to the longitudinal direction, where the blade pressure is relatively high is suppressed to not more than 8 mm. However, for example, in the rear side of the blade 3*a* with respect to the longitudinal direction, the blade pressure is relatively low, and therefore, it is understood that there is no need to form the toner band with the width of 20 mm once per image output of 100 sheets.

4. Control of Toner Band

As described above, the generation degree of the chipping of the blade 3*a* varies depending on the blade pressure (FIG. 3). Further, depending on the blade pressure for each of regions of the blade nip Q with respect to the longitudinal direction of the blade 3*a*, the toner amount of the toner band required to be supplied for reducing the chipping of the blade 3*a* in each of the regions (FIGS. 4 and 5).

Therefore, in this embodiment, on the basis of "pressure distribution information" including information on the blade pressure in a plurality of regions of the blade nip Q with respect to the longitudinal direction of the blade 3*a*, the amount per predetermined number of times of image formation of the toner supplied to each of the plurality of regions is changed by the supplying operation. In this embodiment, in the supplying operation, a size of a predetermined toner image (toner band) caused to reach each of the above-described plurality of regions is changed, so that the amount per predetermined number of times of image formation of the toner supplied to each of the plurality of regions is changed. Particularly, in this embodiment, as the size of the predetermined toner image described above, a length (width) of the toner image with respect to a rotational direction of the photosensitive drum 1 is changed. As a result, not only unnecessary toner consumption can be suppressed but also it becomes possible to achieve lifetime extension of the blade 3*a*. This will be specifically described.

The blade pressure distribution with respect to the longitudinal direction of the blade 3*a* can be measured when the process cartridge 250 is assembled in a factory. For this reason, it is suitable that the pressure distribution information which is information on the blade pressure distribution with respect to the longitudinal direction of the blade 3*a* is marked on the process cartridge 250 during an assembling step of the process cartridge 250. In this embodiment, during the assembling step of the process cartridge 250, the blade pressure in each of a front-side region, a central region and a rear-side region which are obtained by equally dividing the blade nip Q into three regions is measured. Then, a seal 11 (FIG. 1) on which the pressure distribution information including the information on the blade pressure distribution of the measured blade pressure in each of the regions of the blade nip Q with respect to the longitudinal direction of the blade 3*a* is indicated is applied onto the process cartridge 250. Particularly, in this embodiment, as the pressure distribution information, input in which the region (front-side, central, rear-side) of the blade nip Q with respect to the longitudinal direction of the blade 3*a* is associated with a symbol indicating a value (range) of the blade pressure is indicated on the seal 11. The seal 11 on which the pressure distribution information is indicated is applied onto the process cartridge 250 before shipping of the process cartridge 250 (for example, subsequently to the measurement of the blade pressure in the assembling step). Here, the seal 11 is an example of an indicating portion where the pressure distribution information of the process cartridge 250 is indicated. Further, the indicating portion is an example of an information storing member in which the pressure distribution information of the process cartridge 250 is stored.

The blade pressure can be measured as described above in a state in which the photosensitive drum 1 is not incorporated in the process cartridge 250 (in this state, the blade 3*a* is incorporated in the process cartridge 250). As described above, the blade pressure varies depending on a longitudinal position of the blade 3*a* in some instances. This variation generates in some instances due to a variation, of the blade 3*a* itself, such as a material or a dimension of the blade 3*a*, due to a manufacturing variation such as a mounting position or a mounting condition, or the like. Further, for the same reason as that described above, the blade pressure causes, for example, a variation for each of individual process cartridge, 250 (blades 3*a*) or for each of production lots of the process cartridge 250 (blade 3*a*) or for each of production lots of the process cartridge 250 (blade 3*a*) in some cases. Accordingly, the measurement of the blade pressure can be carried out for each unit in which there is a possibility that the variation in blade pressure affecting a degree of generation of the chipping of the blade 3*a* generates. For example, the blade pressure measurement can be carried out for each (individual) process cartridge 250 (blade 3*a*), each production lot of the process cartridge 250 (blade 3*a*) or the like. In the case of measuring the blade pressure for each production lot, a representative constituent part is used, so that the measurement of the blade pressure can be carried out. In the case of using the representative constituent part, value, of the blade pressure measured using a set (pair) of constituent parts may also be used, or an average of values of the blade pressure measured using a plurality of sets of constituent parts may also be used. In this embodiment, the blade pressure measurement is carried out for each process cartridge 250 (blade 3*a*). Further, in this embodiment, the blade nip Q is divided into the three regions with respect to the longitudinal direction of the blade 3*a*, the blade pressure measured at a predetermined position in each region was used as the blade pressure in the region, but the present invention is not limited thereto. The number of divided regions may also be made larger or smaller than that in this embodiment. As regards the number of divided region, a larger number can further improve accuracy of realization of the lifetime extension of the blade 3*a* while suppressing the unnecessary toner consumption, but there is a possibility that the larger number causes a complicated operation and complicated control. Typically, the number of divided regions may suitably be 3 to 10. Incidentally, an average, a representative value (such as a maximum), a sum or the like of values of the blade pressure measured at a plurality of positions in each of the regions of the blade nip Q with respect to the longitudinal direction of the blade 3*a* may also be used as the blade pressure in each of the regions.

Figure 6:
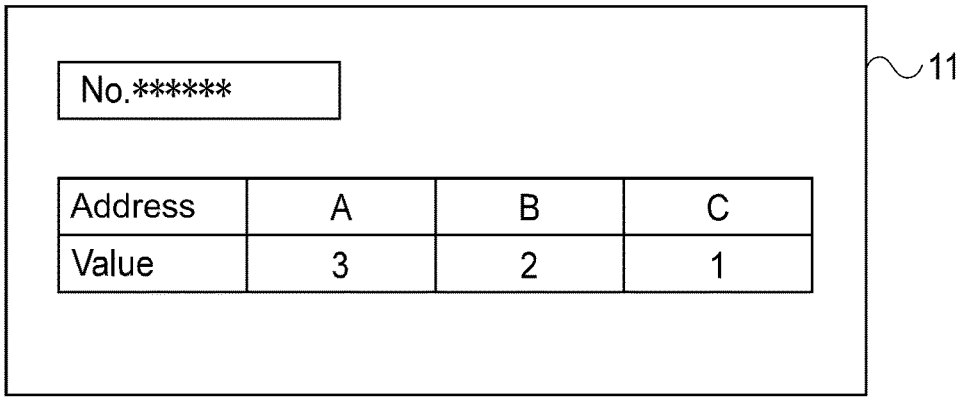
FIG. 6 is a schematic view of a seal on which pressure distribution information of the blade is indicated.

FIG. 6 is a schematic view showing an example of the seal 11 applied onto the process cartridge 250. In FIG. 6, "A", "B" and "C" in an "Address" row correspond to the front-side region F, the central (center-side) region C and the rear-side region R, respectively, of the blade nip Q with respect to the longitudinal direction of the blade 3*a*. Further, "1", "2" and "3" in "Value" row correspond to the following blade pressure ranges. That is, "1" corresponds to the blade pressure in a range of 20 gf/cm or more and less than 25 gf/cm. Further, "2" corresponds to the blade pressure in a range of 25 gf/cm or more and less than 30 gf/cm. Further, "3" corresponds to the blade pressure in a range of 30 gf/cm or more and less than 35 gf/cm.

When an operator such as a user or a service person exchanges the process cartridge 250 with respect to the apparatus main assembly 150, the operator reads the pressure distribution information indicated on the seal 11 applied onto the process cartridge 250 to be newly mounted into the apparatus main assembly 150. Further, the operator inputs the read pressure distribution information to the apparatus main assembly 150. For example, in the case where the process cartridge 250 reaches an end of a lifetime of the process cartridge 250 in a destination, the service person receives notification and goes to the destination, and then exchanges the process cartridge 250. At that time, the service person reads the pressure distribution information indicated on the seal 11 and inputs the read pressure distribution information to the apparatus main assembly 150. Then, in the apparatus main assembly 150 side, depending on the inputted pressure distribution information, a process for controlling the size (the width in this embodiment) of the toner band caused to reach each of the regions of the blade nip Q with respect to the longitudinal direction of the blade 3*a* is carried out.

Figure 7:
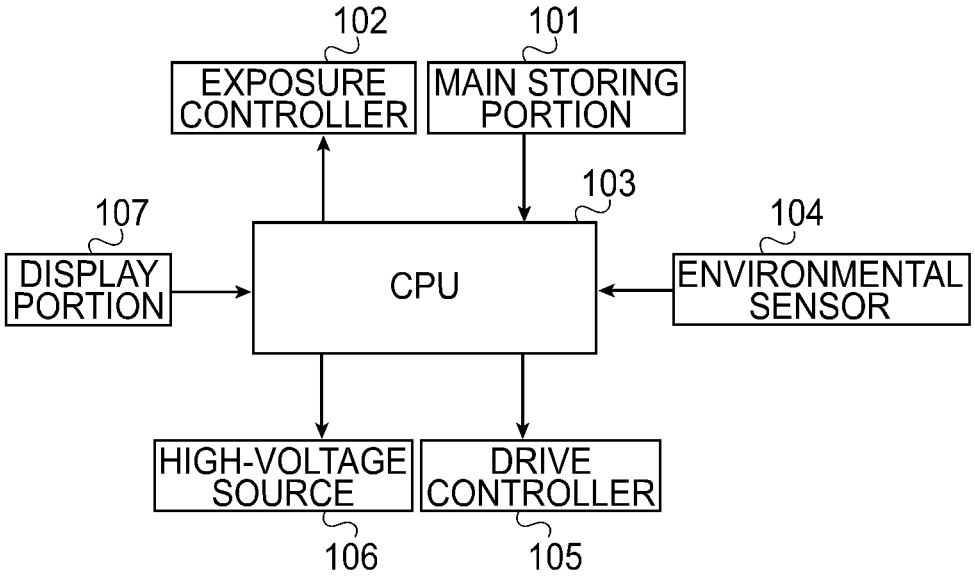
FIG. 7 is a block diagram showing a schematic control mode of the image forming apparatus.

FIG. 7 is a block diagram showing a schematic control mode of the image forming apparatus 100. As described above, in the apparatus main assembly 150, a CPU 103 as a controller and a main assembly storing portion 101 connected with the CPU 103. Further, with the CPU 103, an exposure controller 102 which is a control circuit of the exposure device 21, and an environment sensor 104 as an environment detecting sensor for detecting at least one of a temperature and a humidity in at least one of an inside and an outside of the apparatus main assembly 150. In this embodiment, the environment sensor 104 detects the temperature and the humidity of an environment in which the image forming apparatus 100 is installed (i.e., in an outside environment of the apparatus main assembly 150), and sends the detected information to the CPU 103. Further, with the CPU 103, a driving controller 105 which is a control circuit such as a driving motor for driving the photosensitive drum 1 and a high-voltage source 106 such as the charging voltage source or the transfer voltage source are connected. Further, with the CPU 103, an operation displaying portion 107, such as a touch panel, having a function of an inputting portion through which the information is inputted to the CPU 103 and a function of a displaying portion for displaying the information by the control of the CPU 103 is connected.

The pressure distribution information indicated on the seal 11 applied onto the process cartridge 250 is inputted through the operation displaying portion 107. The CPU 103 causes the main assembly storing portion 101 to store the inputted pressure distribution information.

In this embodiment, as predetermined timing, during non-image formation which is after every 100 sheets as the number of times of image output, the CPU 103 causes the image forming apparatus to carry out the supplying operation in which the toner band is formed on the photosensitive drum 1 and the toner thereof is supplied to the blade nip Q. That is, in this embodiment, the CPU 103 functions as a counting portion and integrates the number of times of image output for each output of the image, and then causes the main assembly storing portion 101 to store the integrated number of times of image output. When the integrated number of times of image output reaches 100 sheets which is a threshold, the CPU 103 recognizes that execution timing of the supplying operation has arrived. Further, in this embodiment, in the case of high-temperature and high-humidity environment in which the chipping of the blade 3*a* is liable to generate, the CPU 103 causes the image forming apparatus to carry out the supplying operation. Then, on the basis of the pressure distribution information inputted through the operation displaying portion 107 and stored in the main assembly storing portion 101, the CPU 13 controls the width of the toner band caused to reach each of the regions of the blade nip Q with respect to the longitudinal direction of the blade 3*a*. When the toner band passes through the transfer portion N, the CPU 103 turns off application of the transfer bias to the transfer roller 22. At this time, to the transfer roller 22, a voltage of the same polarity as a normal charge polarity of the toner may also be applied.

Figure 8:
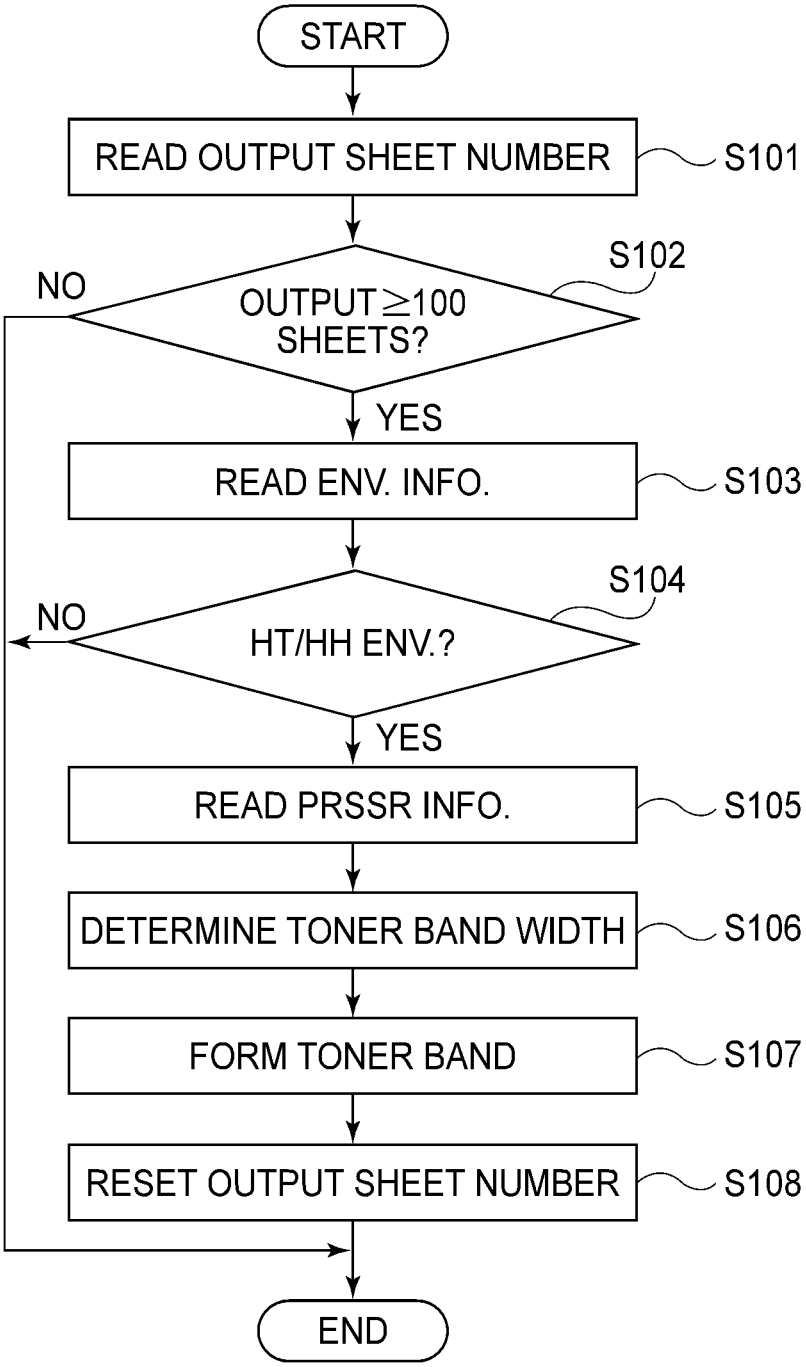
FIG. 8 is a schematic flowchart of an operation of forming the toner band.

FIG. 8 is a schematic flowchart of control for executing the supplying operation in this embodiment. In this embodiment, the supplying operation is executed during a sheet interval of a job. The CPU 103 reads, for each output of the image on a single sheet, the number of image output sheets integrated and stored in the main assembly storing portion 101 (S101), and discriminates whether or not the number of image output sheets reaches 100 sheets (S102). In S102, in the case where the CPU 103 discriminated that the number of image output sheets reaches 100 sheets, the CPU 103 reads temperature and humidity information in the environment detected by the environment sensor 104 (S103), and discriminates whether or not the read information indicates a high-temperature (25° C. or more) and high-humidity (60% RH or more) environment (S104). In S104, in the case where the CPU 103 discriminated that the read information indicates the high-temperature and high-humidity environment, the CPU 103 reads the pressure distribution information stored in the main assembly storing portion 101 (S105). Then, on the basis of information showing a relationship, between the blade pressure and the toner band width, which is set in advance as shown in Table 2 below, the CPU 103 determines the width of the toner band caused to reach each of the regions of the blade nip Q with respect to the longitudinal direction of the blade 3*a* (S106). In this embodiment, the information indicating the relationship as shown in Table 2 is stored in advance in the main assembly storing portion 101.

TABLE 2

| | CP[+1] | | |
|---|---|---|---|
| | 1 | 2 | 3 |
| Frequency | 0 | 1/100*[2] | 1/100*[2] |
| Width | — | 10 mm | 20 mm |

[+1]"CP" is the contact pressure.
*[2]"1/100" represents once per 100 sheets.

As shown in Table 2, in this embodiment, in the case where the blade pressure ("Value" indicated on the seal 11) is "1", the toner band is not formed (toner band width: 0 mm). In the case where the blade pressure is "2", the toner band width is 10 mm. In the case where the blade pressure is "3", the toner band width is 20 mm. In this embodiment, irrespective of the value of the blade pressure, a density (toner weight per unit area) of the toner band is constant at a predetermined density (predetermined half tone or solid density (maximum density level)).

Figure 9:
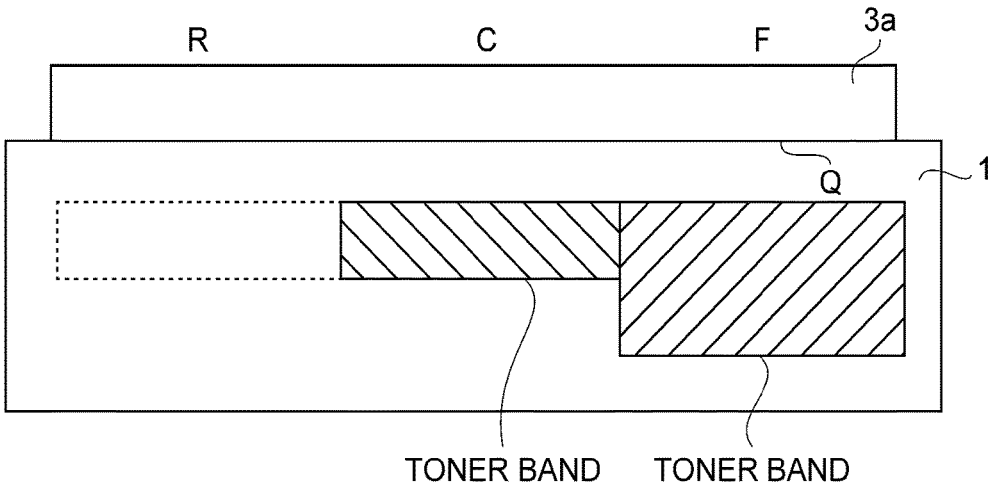
FIG. 9 is a schematic view of the toner band.

Then, the CPU 103 controls the exposure controller 102, the high-voltage source 106 and the drive controller 105, so that the toner band is formed on the photosensitive drum 1 and the toner thereof is supplied to the blade nip Q (S107). This toner band has the width determined in S106 at each of portions supplied to the regions, respectively, of the blade nip Q with respect to the longitudinal direction of the blade 3*a* as shown in FIG. 9. FIG. 9 schematically shows the toner band in the case where the pressure distribution information indicated on the seal 11 is the example shown in FIG. 6. Thereafter, the CPU 103 resets the number of image output sheets stored in the main assembly storing portion 101 to zero (S108).

Thus, in this embodiment, depending on the blade pressure in each of the regions of the blade nip Q with respect to the longitudinal direction of the blade 3*a*, the CPU 13 changes the toner amount of the toner band, per predetermined number of times of image formation, supplied to each of the regions by changing the size of the toner band caused to reach each of the regions. At this time, the CPU 103 makes the toner amount smaller in the region where the blade pressure is a second contact pressure smaller than a first contact pressure than in the region where the blade pressure is the first contact pressure. That is, in this embodiment, the size of the toner image caused to reach the region when the blade pressure is the second contact pressure smaller than the first contact pressure is made smaller than the size of the toner image caused to reach the region where the blade pressure is the first contact pressure. In this embodiment, as the size of the toner image, the width (length with respect to the rotational direction of the photosensitive drum 1) of the toner band was changed, but the present invention is not limited thereto. The toner of the toner band moves (extends) also in the longitudinal direction of the blade 3*a* to some degree when the toner band is scraped off by the blade 3*a*, and therefore, a longitudinal length of the blade 3*a* may also be changed. Both of the toner band width and the longitudinal length of the blade 3*a* may also be changed. Further, the toner band is divided into a plurality of portions with respect to at least one of the widthwise direction and the longitudinal direction of the blade 3*a*, and a sum of lengths of the toner band with respect to the divided direction may also be changed.

The pressure distribution information stored in the main assembly storing portion 101 is rest for each exchange of the process cartridge 250. Further, in the case where the pressure distribution information is not stored in the main assembly storing portion 101 for some reason, the CPU 103 can control the toner band width in a state in which the blade pressure in all of the regions of the blade nip Q with respect to the longitudinal direction of the blade 3*a* is "3", for example.

As described above, according to this embodiment, the toner band width is adjusted depending on the blade pressure distribution with respect to the longitudinal direction of the blade 3*a*, so that not only the chipping amount of the blade 3*a* can be suppressed substantially uniformly with respect to the longitudinal direction of the blade 3*a* but also it becomes possible to suppress the toner consumption amount.

Embodiment 2

Then, another embodiment of the present invention will be described. A basic constitution and an operation of an image forming apparatus in this embodiment are the same as those in Embodiment 1. Accordingly, in the image forming apparatus in this embodiment, elements having the same or corresponding functions and constitutions as those in the image forming apparatus of Embodiment 1 are represented by the same reference numerals or symbols and will be omitted from description.

In Embodiment 1, the toner amount of the toner band supplied to each of the regions was changed by changing the size of the toner band caused to reach each of the regions of the blade nip Q with respect to the longitudinal direction of the blade 3*a*. On the other hand, in this embodiment, the toner amount of the toner band supplied to each of the regions is changed by changing the density (toner weight per unit area) of the toner band caused to reach each of the regions of the blade nip Q with respect to the longitudinal direction of the blade 3*a*.

In this embodiment, in S106 of FIG. 8, on the basis of information showing a relationship, between the blade pressure and the toner band density, which is set in advance as shown in Table 3 below, the CPU 103 determines the density of the toner band caused to reach each of the regions of the blade nip Q with respect to the longitudinal direction of the blade 3*a*. In this embodiment, the information indicating the relationship as shown in Table 3 is stored in advance in the main assembly storing portion 101.

TABLE 3

| | CP[+1] | | |
|---|---|---|---|
| | 1 | 2 | 3 |
| Frequency | 0 | 1/100*[2] | 1/100*[2] |
| Density*[3] | — | X | Y (>X) |

[+1]"CP" is the contact pressure.
*[2]"1/100" represents once per 100 sheets.
*[3]"Density" is the density of the toner band.
"X" is X (>0) mg/cm$^2$, and "Y" is Y (>X) mg/cm$^2$.

As shown in Table 3, in this embodiment, in the case where the blade pressure ("Value" indicated on the seal 11) is "1", the toner band is not formed (toner band density: 0 mg/cm$^2$). In the case where the blade pressure is "2", the toner band density is a predetermined X (>0) mg/cm$^2$ (e.g., 0.3 mg/cm$^2$). In the case where the blade pressure is "3", the toner band density is a predetermined Y (>X) mg/cm$^2$ (e.g., 0.5 mg/cm$^2$). The toner band density can be controlled by controlling an exposure amount of the exposure device 3. In this embodiment, the toner band density is represented by a toner amount (weight) per unit area, but may also be information on a density level designating the exposure amount of the exposure device 3.

Thus, in this embodiment, depending on the blade pressure in each of the regions of the blade nip Q with respect to the longitudinal direction of the blade 3*a*, the CPU 13 changes the toner amount of the toner band supplied to each of the regions by changing the density of the toner band caused to reach each of the regions. At this time, the CPU 103 makes the density smaller in the region where the blade pressure is a second contact pressure smaller than a first contact pressure than in the region where the blade pressure is the first contact pressure.

As described above, according to this embodiment, the toner band density is adjusted depending on the blade pressure distribution with respect to the longitudinal direction of the blade 3*a*, so that not only the chipping amount of the blade 3*a* can be suppressed substantially uniformly with respect to the longitudinal direction of the blade 3*a* but also it becomes possible to suppress the toner consumption amount.

Embodiment 3

Then, another embodiment of the present invention will be described. A basic constitution and an operation of an image forming apparatus in this embodiment are the same as those in Embodiments 1 and 2. Accordingly, in the image forming apparatus in this embodiment, elements having the same or corresponding functions and constitutions as those in the image forming apparatus of Embodiments 1 and 2 are represented by the same reference numerals or symbols and will be omitted from description.

In Embodiments 1 and 2, not only the supplying operation is executed at a predetermined execution frequency, but also in each supplying operation, the width and density, per predetermined number of times of image formation, of the toner band caused to reach each of the regions of the blade nip Q with respect to the longitudinal direction of the blade 3*a* were adjusted. On the other hand, in this embodiment, the toner amount of the toner band supplied to each of the regions is changed by changing a frequency of formation of the toner band caused to reach each of the regions of the blade nip Q with respect to the longitudinal direction of the blade 3*a*.

That is, the toner and the external additive thereof which exist in the blade nip Q gradually decreases with an increasing traveling distance (number of times of rotation) of the photosensitive drum 1, so that the chipping of the blade 3*a* is liable to generate. For that reason, in the case where the blade pressure is relatively high and the chipping of the blade 3*a* is liable to generate, it is desired that the toner is supplied to the blade nip Q at a high frequency. On the other hand, in the case where the blade pressure is relatively low and the chipping of the blade 3*a* does not readily relatively generates, a toner consumption amount can be reduced by relatively lowering, a frequency of supply of the toner to the blade nip Q.

In this embodiment, the CPU 103 counts the number of image output sheets for discriminating timing of formation of each of toner bands caused to reach the respective regions of the blade nip Q with respect to the longitudinal direction of the blade 3*a*, and causes the main assembly storing portion 101 to store the counted number. The CPU 103 compares the integrated number of image output sheets for each of the regions with a threshold set depending on the blade pressure in each of the regions, and discriminates whether or not timing of formation of the toner band has arrived. Then, in the case where the toner band is formed, the CPU 103 resets the number of image output sheets integrated for the associated region to zero.

On the basis of information showing a relationship, between the blade pressure and the frequency of formation of the toner band, which is set in advance as shown in Table 4 below, the CPU 103 discriminates formation timing of the toner band caused to reach each of the regions of the blade nip Q with respect to the longitudinal direction of the blade 3*a*. In this embodiment, the information indicating the relationship as shown in Table 4 is stored in advance in the main assembly storing portion 101.

TABLE 4

| | CP[+1] | | |
|---|---|---|---|
| | 1 | 2 | 3 |
| Frequency | 0 | 1/200*[2] | 1/100*[3] |
| Width | — | 20 mm | 20 mm |
| Density*[3] | — | Y mg/cm$^2$ | Y mg/cm$^2$ |

[+1]"CP" is the contact pressure.
[*2]"1/200" represents once per 200 sheets.
[*3]"1/100" represents once per 100 sheets.

As shown in Table 4, in this embodiment, in the case where the blade pressure ("Value" indicated on the seal 11) is "1", the toner band is not formed. In the case where the blade pressure is "2", the toner band is formed every 200 sheets as the number of image output sheets. In the case where the blade pressure is "3", the toner band is formed every 100 sheets as the number of image output sheets. In this embodiment, irrespective of a value of the blade pressure, the toner band width is constant at 20 mm, and the toner band density is constant at a predetermined density Y mg/cm$^2$.

Thus, in this embodiment, depending on the blade pressure in each of the regions of the blade nip Q with respect to the longitudinal direction of the blade 3*a*, the CPU 13 changes the toner amount of the toner band supplied to each of the regions by changing the formation frequency of the toner band caused to reach each of the regions. At this time, the CPU 103 makes the frequency smaller in the region where the blade pressure is a second contact pressure smaller than a first contact pressure than in the region where the blade pressure is the first contact pressure.

As described above, according to this embodiment, the toner band formation frequency is adjusted depending on the blade pressure distribution with respect to the longitudinal direction of the blade 3*a*, so that not only the chipping amount of the blade 3*a* can be suppressed substantially uniformly with respect to the longitudinal direction of the blade 3*a* but also it becomes possible to suppress the toner consumption amount.

Embodiment 4

Then, another embodiment of the present invention will be described. A basic constitution and an operation of an image forming apparatus in this embodiment are the same as those in Embodiments 1 to 3. Accordingly, in the image forming apparatus in this embodiment, elements having the same or corresponding functions and constitutions as those in the image forming apparatus of Embodiments 1 to 3 are represented by the same reference numerals or symbols and will be omitted from description.

In Embodiments 1 to 3, the pressure distribution information was indicated on the seal 11 applied to the process cartridge 250. On the other hand, in this embodiment, the pressure distribution information is stored in an IC tag 109 (FIG. 10) mounted to the process cartridge 250. The IC tag 109 is an example of a storing medium in which the pressure distribution information of the process cartridge 250 is stored. The storing medium is an example of an information storing member storing the pressure distribution information of the process cartridge 250.

In the case where the pressure distribution information is held on the seal 11 as in Embodiments 1 to 3, the operator manually inputs the pressure distribution information during exchange of the process cartridge 250, and therefore, it would be considered that the operator erroneously inputs the pressure distribution information. Therefore, in this embodiment, the pressure distribution information is inputted and stored in the IC tag 109 during an assembling step or the like of the process cartridge 250.

Figure 10:
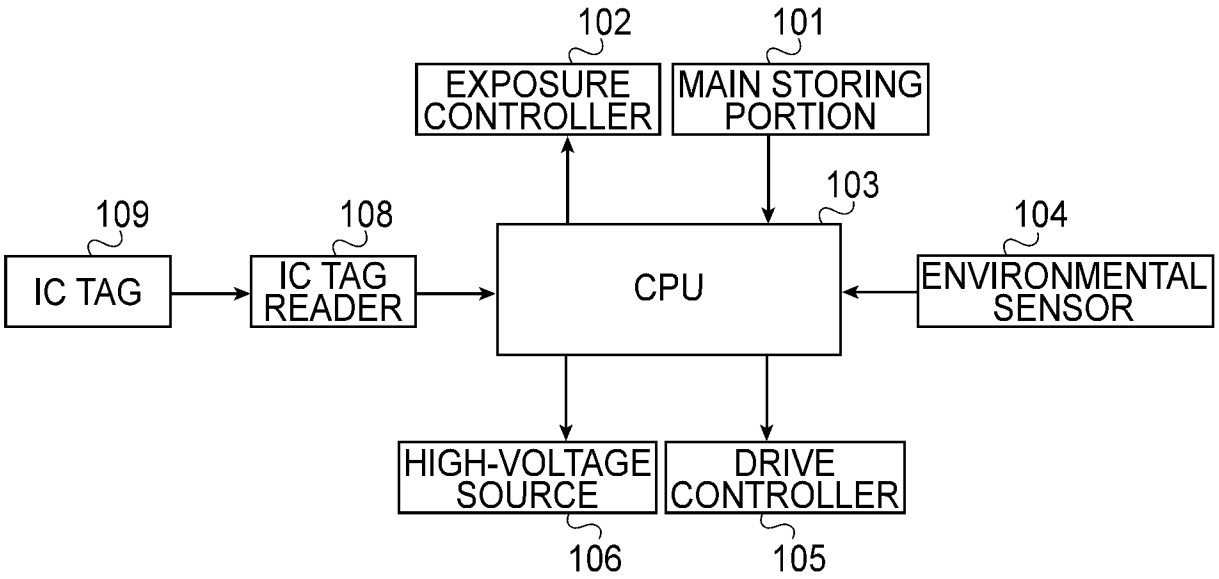
FIG. 10 is a block diagram showing a schematic control mode of the image forming apparatus in another embodiment.

FIG. 10 is a block diagram showing a schematic control mode of an image forming apparatus in this embodiment. The IC tag 109 is a memory tag including a nonvolatile memory and is mounted to the process cartridge 250. On the other hand, the apparatus main assembly is provided with an IC tag reading portion 108 for reading the information stored in the IC tag 109 and for inputting the information to the CPU 103. When the process cartridge 250 is mounted in the apparatus main assembly 150, the IC tag 109 is connected with the IC tag reading portion 108. As a result, the pressure distribution information stored in the IC tag 109 is inputted to the CPU 103 by the IC tag reading portion 108. Then, on the basis of the information inputted by the IC tag reading portion 108, the CPU 103 controls the toner band forming operation similarly as in Embodiments 1 to 3. Incidentally, the pressure distribution information read from the IC tag 109 may also be stored once in the main assembly storing portion 101.

As described above, according to this embodiment, not only effects similar to those in Embodiments 1 to 3 can be obtained, but also an error when the pressure distribution information is inputted is prevented and thus proper control of the toner band forming operation can be facilitated.

Other Embodiments

The present invention was described based on the specific embodiments mentioned above, but is not limited to the above-mentioned embodiments.

The methods of changing the amount of the toner supplied to each of the regions of the blade nip with respect to the longitudinal direction of the blade described in Embodiments 1 to 3 can be used arbitrarily in combination. That is, the amount of the toner supplied to each of the regions can be changed by changing two or more of the size, the density and the formation frequency of the toner band.

Further, in Embodiments 1 to 3, the pressure distribution information was indicated on the seal (i.e., the indicating portion provided on the process cartridge itself) applied onto the process cartridge, but the present invention is not limited thereto. A provider of the process cartridge can present the pressure distribution information to the operator through any means for each of individual process cartridges or for each of production lots, or the like. For example, the provider can present the contact pressure information and the initial film thickness information through articles, such as a package and a manual of the process cartridge, circulated together with the process cartridge or through the process cartridge on a network or on a homepage (website) of the provider of the image forming apparatus.

In Embodiments 1 to 3, the operator inputted the pressure distribution information, but the information inputted by the operator may also be an individual identification number or a lot number of the process cartridge when the information is capable of identifying the pressure distribution information in the process cartridge. For example, there is a case that the controller provided in the apparatus main assembly is connected with the network through a network-connecting portion. In this case, for example, the pressure distribution information may also be stored, in a state of being associated with the individual identification number or the lot number, in an external storing portion at a service location of the provider of the process cartridge or the image forming apparatus. This external storing portion and the controller provided in the apparatus main assembly are connected with the network through the network-connecting portion. The operator inputs the individual identification number or the lot number of the process cartridge mounted in the apparatus main assembly to the controller through the operating portion provided on the apparatus main assembly. The individual identification number and the lot number can be presented by the process cartridge itself or the articles, such as the package and the manual of the process cartridge, circulated together with the process cartridge. Then, the controller is capable of acquiring, from the external storing portion, the pressure distribution information corresponding to the inputted individual identification number and the inputted lot number.

In Embodiment 4, the storing of the pressure distribution information in the storing medium provided in the process cartridge was described. Thus, in the case where the storing medium is provided to the process cartridge, also the information indicating the relationships as shown in Tables 2 to 4 described above in Embodiments 1 to 3 can be stored and held in the storing medium of the process cartridge. As a result, also in the case where a design change of the process cartridge is made, the control similar to those in the above-described embodiments can be carried out without requiring the change in the apparatus main assembly side. Also in this case, these pieces of information read from the storing medium of the process cartridge may also be once stored in the main assembly storing portion and then may be used.

In the above-described embodiments, the input portion and the operating the display portion having the function of the display portion were provided on the apparatus main assembly, but these means (portions) may also be those provided in, for example, a device (such as a personal computer) communicatably connected with the apparatus main assembly.

In the above-described embodiments, in the image forming apparatus is of a process cartridge detachably mountable type, but the present invention is not limited thereto. The cleaning member and the photosensitive member may also be individually exchangeable. The process cartridge is in general prepared by integrally assembling the photosensitive member and at least one of the charging means, the developing device and the cleaning member which are means actable on the photosensitive member into a cartridge (unit), which is detachably mountable to the apparatus main assembly.

Further, in the above-described embodiments, the case where the contact pressure of the cleaning member to the photosensitive member was different depending on the manufacturing variation was described as an example, but the present invention is not limited thereto. For example, the present invention is applicable even in the case where the setting of the contact pressure is intentionally changed due to an arbitrary reason such as a change in setting due to a difference in type (model) of the image forming apparatus, a change in setting due to a use (operation) environment or use status of the image forming apparatus by the user, or the like.

The present invention particularly suitably acts on the case where the cleaning member is a blade-shaped member, but the cleaning member is not limited to the blade-shaped cleaning member. For example, in the case where a cleaning member, such as a block-shaped (pad-shaped) cleaning member, of which difference in contact pressure to the photosensitive member has the influence on a degree of generation of inconveniences such as chipping, turning-up, and noise is used, an effect similar to the above-described effect can be expected by applying the present invention to the cleaning member.

In the above-described embodiments, whether or not the supplying operation should be executed is discriminated depending on the environment in which the image forming apparatus is installed, but the supplying operation may also be executed irrespective of the environment.

Figure 11:
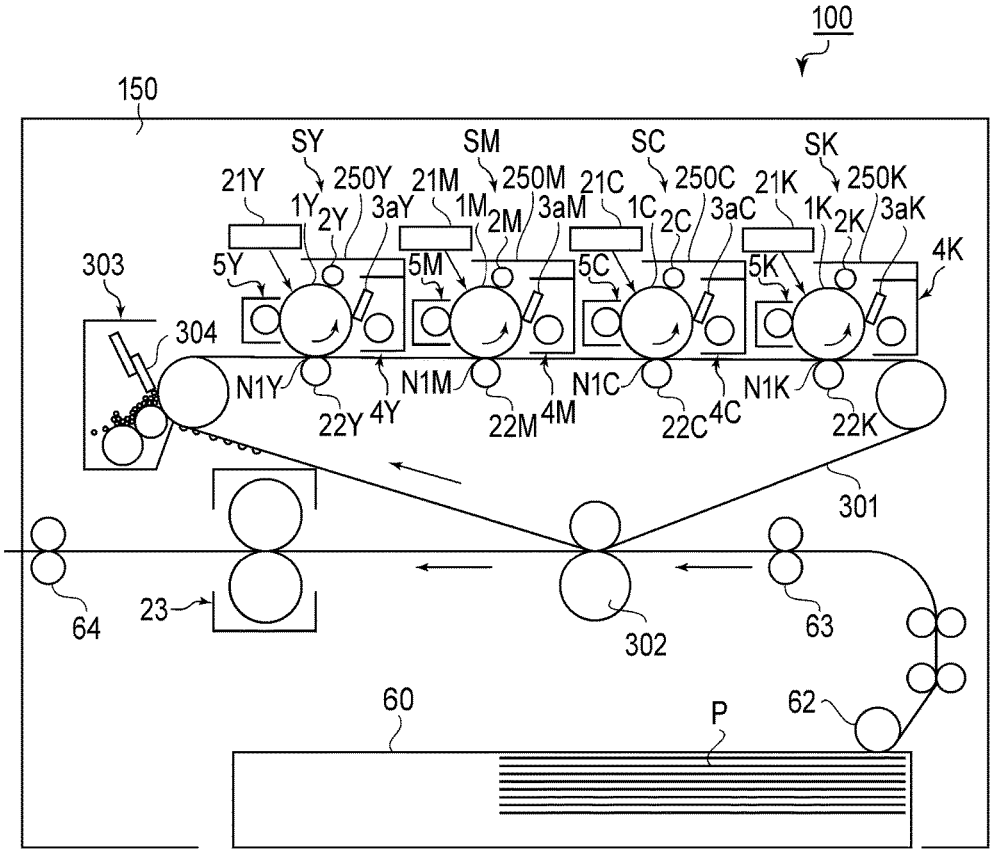
FIG. 11 is a schematic sectional view of an image forming apparatus in another embodiment.

In the above-described embodiments, the image forming apparatus is a monochromatic image forming apparatus, but the present invention is also applicable to a color image forming apparatus capable of forming a full-color image, or the like. For example, FIG. 11 is a schematic sectional view of an example of a color image forming apparatus of a tandem type employing an intermediary transfer type. In FIG. 11, elements having the same or corresponding functions or constitutions as those in the above-described embodiments are represented by the same reference numerals or symbols. Further, as suffixes of the numerals or symbols representing the elements, having the same or corresponding functions or constitutions, provided for the colors of yellow, magenta, cyan and black, symbols Y, M, C and K are added, respectively.

The image forming apparatus 100 shown in FIG. 11 includes four image forming portions S each including a photosensitive drum 1 as a first image bearing member, and includes an intermediary transfer belt 301 as a second image bearing member. The intermediary transfer belt 301 is an example of an intermediary transfer member for feeding a toner image, primary-transferred from the photosensitive drum 1, so as to be secondary-transferred onto a recording material P. The toner image formed on the photosensitive drum 1 of each of the image forming portions S is primary-transferred onto the intermediary transfer belt 301 at an associated one of primary transfer portions by the action of an associated one of primary transfer rollers 22. Thereafter, the toner images on the intermediary transfer belt 301 are secondary-transferred onto the recording material P at a secondary transfer portion by a secondary transfer roller 302 as a secondary transfer member. Toner remaining on the intermediary transfer belt 301 after a secondary transfer step is removed and collected from the intermediary transfer belt 301 by a belt cleaning device 303 as an intermediary transfer member cleaning member. The belt cleaning device 303 includes a blade 304 as a cleaning member contacted to the intermediary transfer belt 301 counterdirectionally to a movement direction of the intermediary transfer belt 301.

In the above-described image forming apparatus 100, the present invention can be applied to a blade 3*a* for cleaning each of the photosensitive drums 1. Further, the present invention can also be applied to a blade 304 for cleaning the intermediary transfer belt 301. In this case, a toner band formed on at least one of the plurality of photosensitive drums 1 is transferred onto the intermediary transfer belt 301 and is caused to pass through the secondary transfer portion, so that the toner of the toner band can be supplied to a contact portion between the blade 304 and the intermediary transfer belt 301. When the toner band passes through the secondary transfer portion, a voltage applied to the secondary transfer roller 302 can be placed in an off state or changed to a voltage of the same polarity as the normal charge polarity of the toner, or the secondary transfer roller 302 can be spaced from the intermediary transfer belt 301. In such an image forming apparatus 100, for example, a unit (intermediary transfer belt unit) including the intermediary transfer belt 301 and the belt cleaning device 303 is detachably mountable to an apparatus main assembly 150 in some instances. For that reason, the pressure distribution information can be held on a seal applied to the unit or stored in a storing medium provided to the unit. The above-described other presentation methods of the pressure distribution information may also be employed.

In Embodiments 5 to 8 described below, on the basis of information on contact pressure of the cleaning blade of each of the photosensitive members, as station and a longitudinal position of the photosensitive member on which a supplying toner to the cleaning blade of the intermediary transfer member is formed are determined.

Embodiment 5

Figure 12:
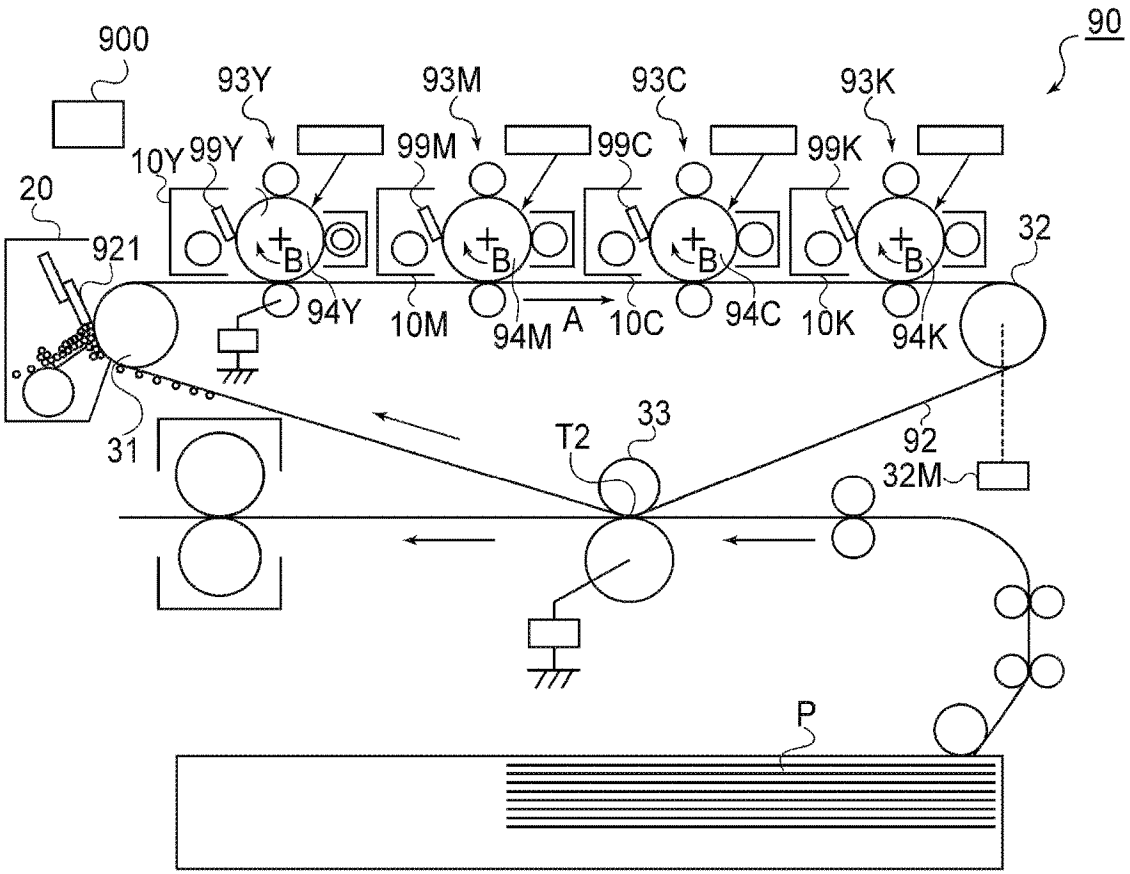
FIG. 12 is a schematic sectional view of an image forming apparatus in another embodiment.

As shown in FIG. 12, an image forming apparatus 90 is a full-color printer of a tandem type and an intermediary transfer type. In an image forming portion 93Y, a yellow toner image is formed on a photosensitive drum 94Y and is transferred onto an intermediary transfer belt 92. In an image forming portion 93M, a magenta toner image is formed on a photosensitive drum 94M and is transferred onto the intermediary transfer belt 92. In image forming portions 93C and 93K, a cyan toner image and a black toner image are formed on photosensitive drums 94C and 94K, respectively, and are transferred onto the intermediary transfer belt 92.

The four color toner images transferred on the intermediary transfer belt 92 are fed to a secondary transfer portion T2 and are secondary-transferred altogether onto the recording material (transfer material, sheet) P.

In FIG. 12, a CPU 900 as a controller also functions as an acquiring portion (for acquiring contact pressure information to the photosensitive drum or contact pressure distribution information with respect to the longitudinal direction of the photosensitive drum) and a toner band forming portion.

In Embodiment 5, a drum cartridge detachably mountable to an image forming apparatus main assembly is provided. The drum cartridge integrally includes the photosensitive drum 94 carrying the toner image corresponding to a predetermined color, a cleaning blade 99 and a memory member as a storing member. This memory member stores the contact pressure information of the cleaning blade 99 to the photosensitive drum 94 or the contact pressure distribution information with respect to the longitudinal direction.

As regards cleaning of the image bearing member, a cleaning device 10 for the photosensitive drum 94 and a belt cleaning device 20 for the intermediary transfer belt 92 exist, and there is a need to supply a toner band (toner patch) to each of the cleaning devices.

The intermediary transfer belt 92 shown in FIG. 12 is supported by a tension roller 31, a driving roller 32 and an opposite roller 33, and is rotated in an arrow A direction by being driven by a driving motor 32M.

The belt cleaning device 20 shown in FIG. 12 rubs the intermediary transfer belt 92 with a cleaning blade 921 with respect to the longitudinal direction (axial direction (rotational axis direction) of the intermediary transfer belt 92), and thus collects residual toner which is deposited on the intermediary transfer belt 92 after passing through the secondary transfer portion T2 and which is not transferred onto the recording material P.

Figure 13:
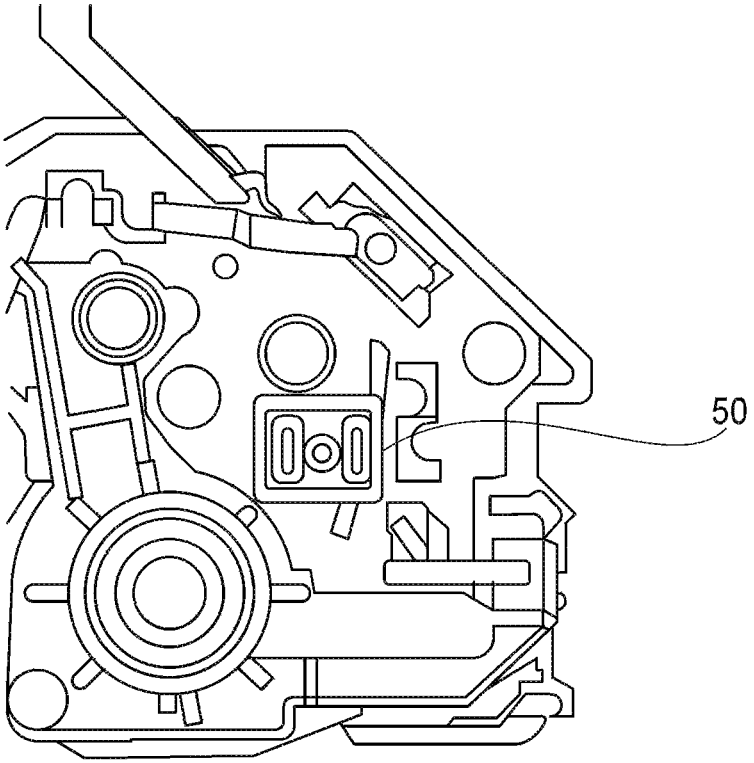
FIG. 13 is an illustration of a drum cartridge including a tag in the image forming apparatus in another embodiment.

In this embodiment, a contact pressure (g/cm) in the case where the photosensitive drum 94 is divided into five portions with respect to the longitudinal direction is acquired. In this embodiment, a memory member (tag) as a storing member for storing the blade pressure information in the drum cartridge is provided. As shown in FIG. 13, a tag 50 is mounted to a side cover of the drum cartridge.

In the tag 50, necessary information (in this embodiment, lot numbers of the drum cartridge and the cleaning blade, longitudinal information on the cleaning blade pressure, and the like) is inputted in advance. When the drum cartridge is mounted in the image forming apparatus main assembly, tag 50 transfers the information between itself and the image forming apparatus main assembly, and notifies the longitudinal information of the cleaning blade pressure to a control substrate of the image forming apparatus main assembly, so that the toner band described later (toner band formed in advance) is changed.

The longitudinal information of the cleaning blade pressure is prepared by measuring the blade pressure and by associating a longitudinal position with partial pressure (g) data. The partial pressure (g) may also be linear pressure (g/cm).

In this embodiment, the toner band is formed on the photosensitive drum 94 by the CPU 900 which is a controller functioning as a toner band forming means, and is transferred onto the intermediary transfer belt 92. At this time, a transfer efficiency is not 100% in general, so that the toner band is formed on not only the intermediary transfer belt 92 but also the photosensitive drum 94. In order to increase an amount of the toner band supplied to the photosensitive drum 94, a primary transfer high-voltage may also be adjusted.

Then, on the basis of the contact pressure information to the photosensitive drum 94 or the contact pressure distribution information with respect to longitudinal direction which are stored in the above-described tag 50, the photosensitive drum 94 providing a relatively high contact pressure or the longitudinal position of the photosensitive drum 94 is determined. During comparison, the above-described pieces of information are relatively compared with each other among the plurality of photosensitive drums or are relatively compared with a predetermined pressure, so that the photosensitive drum 94 or the longitudinal position is determined. On the determined photosensitive drum 94, the toner band is formed over the longitudinal direction, or the toner band is formed at the determined longitudinal P.

Embodiment 6

In Embodiment 5, the image forming apparatus in which the longitudinal information of the cleaning blade pressure or the like was stored in the tag of the drum cartridge was described. On the other hand, in Embodiment 6, the longitudinal information of the cleaning blade pressure or the like is stored in a storing member in the image forming apparatus main assembly.

In this embodiment, when the drum cartridge is mounted in the image forming apparatus main assembly, the longitudinal information of the cleaning blade pressure attached to the drum cartridge is inputted by the user (operator) through an input portion of the image forming apparatus. The inputted information is stored in an information storing member (storing member) provided in the image forming apparatus main assembly. The stored information is notified to the control substrate of the image forming apparatus main assembly, so that the toner band is changed. Further, as occasion arises, writing of information such as a toner band condition is also carried out.

Next, the case where the image forming apparatus main assembly is connected with a network will be described. The longitudinal information of the cleaning blade pressure is stored together with a lot number of the drum cartridge in an external storing member in a customer center or the like. The external storing member and the image forming apparatus main assembly are connected with each other through the network.

The user (operator) inputs the lot number or the like of the drum cartridge to be mounted in the image forming apparatus main assembly through the input portion of the image forming apparatus. Then, the inputted lot number of the drum cartridge is sent to the external storing member, and then, the image forming apparatus acquires the longitudinal information of the cleaning blade pressure from the external storing member. Then, the acquired longitudinal information of the cleaning blade pressure or the like is stored in the storing member in the image forming apparatus main assembly. The stored information is notified to the control substrate of the image forming apparatus main assembly, so that the toner band is changed.

Similarly as in Embodiment 5, also in this embodiment, the toner band is formed on the photosensitive drum 94, and is transferred onto the intermediary transfer belt 92. At this time, a transfer efficiency is not 100% in general, so that the toner band is supplied to not only the cleaning blade of the intermediary transfer belt 92 but also the cleaning blade of the photosensitive drum 94. In order to increase an amount of the toner band supplied to the photosensitive drum 94, a primary transfer high-voltage may also be adjusted.

Embodiment 7

In this embodiment, a toner band station (image forming portion) adjustment is carried out. That is, on the basis of the longitudinal information of the cleaning blade pressure described in Embodiments 5 and 6, relative comparison is made among the drum cartridges incorporated in the image forming apparatus main assembly. As a result of the comparison, at the image forming portion where the drum cartridge which has a high partial pressure of the cleaning blade pressure or a high total pressure of the sum of partial pressures, the toner band is formed on the photosensitive drum and the intermediary transfer member at the longitudinal position or over the longitudinal direction.

In this embodiment, by comparing values of the blade pressure information in the plurality of drum cartridges, the photosensitive drum with a relatively high contact pressure or the longitudinal position of the photosensitive drum is identified. Then, the toner band for the color relating to the identified photosensitive drum is formed on the intermediary transfer belt and the photosensitive drum over the longitudinal direction or at the longitudinal position.

In this embodiment, in the image forming portion where the drum cartridge has the high partial pressure or the high total pressure of the cleaning blade pressure, the toner band is supplied to the intermediary transfer member. At this time, as described above, the primary transfer voltage is 0 V, and therefore, the toner band is also supplied to the photosensitive drum. Then, as regards the drum cartridge in which the partial pressure or the total pressure is low, a possibility of generation of turning-up of the cleaning blade is low, and therefore, there is no need to prepare the toner band at the station, so that unnecessary toner consumption is reduced.

That is, in this embodiment, values of the contact pressure of the cleaning members contacting the plurality of image bearing members for carrying the toner images corresponding to the respective different colors are taken into consideration, so that a necessary toner band can be formed on a necessary transfer.

In this embodiment, while ensuring a toner amount necessary for transfer cleaning (intermediary transfer member), depending on the longitudinal information of the cleaning blade pressure described in Embodiments 1 and 2, relative comparison is made and the above-described toner band forming frequency is changed.

That is, as a result of the relative comparison, at the station (image forming portion) where the drum cartridge having the high partial pressure or the total pressure is provided, a frequency of formation of the toner band at the longitudinal position or over the longitudinal direction of the photosensitive drum and the intermediary transfer member is increased. As a result, it becomes possible to suppress the generation of the turning-up of the blade while minimizing the toner consumption.

In this embodiment, as a precondition, the toner band is formed at a single station (image forming portion) by single toner band control associated with the toner band formation frequency, but the number of the stations may also be any number when the toner amount necessary for the transfer cleaning is ensured. That is, the single toner band control, the toner band may also be formed at the plurality of stations (image forming portions).

Further, while ensuring the toner amount necessary for the transfer cleaning (intermediary transfer member), depending on the longitudinal information of the cleaning blade for each station, longitudinal dimensions (lengths) of the toner bands formed at the respective stations may also be different from each other. That is, the longitudinal dimension of the toner band may also be made longer at the station where the blade pressure is higher.

Embodiment 8

In this embodiment, when the contact pressure (blade pressure) of the cleaning blade is high, as a longitudinal distribution of the toner band, either one of an increase of the toner band density and an increase of the longitudinal dimension is carried out. Other constitutions are similar to those in Embodiment 7.

In this embodiment, for each of partial pressures of the drum cartridge, the toner band density is increased at a high partial pressure position and is decreased at a low partial pressure position. Then, the thus formed toner band is adjusted so as to provide an amount necessary for the transfer cleaning over the entire longitudinal region.

In Embodiment 8, it became possible to suppress the generation of the turning-up of the blade while minimizing the toner consumption.

In the present invention, a similar result is achieved also by increasing the longitudinal dimension of the toner band.

The present invention is also applicable to the case where there is no toner band formed and advance and the toner band is newly formed on the basis of the contact information of the cleaning blade or the longitudinal contact pressure distribution information.

In the present invention, the intermediary transfer belt can also be replaced with a recording material (transfer material) feeding belt.

The recording material used in the present invention may also be, in addition to irregular plain paper, thick paper, thin paper, envelope, postcard, seal, resin sheet, OHP sheet, glossy paper and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2016-151874 filed on Aug. 2, 2016 and 2016-168554 filed on Aug. 30, 2016, which are hereby incorporated by reference herein in their entirety.

What is claimed is:

1. An image forming apparatus comprising:

a unit configured to be detachably mountable to a main assembly of said image forming apparatus, said unit including:

an image bearing member configured to bear a toner image, a cleaning blade contacting said image bearing member at a cleaning portion and being configured to remove deposited matter on said image bearing member with movement of said image bearing member, and an information storing member configured to store pressure information measured during an assembling step of said unit, the pressure information being information on contact pressures of said cleaning blade to said image bearing member with respect to a widthwise direction perpendicular to a movement direction of said image bearing member in each of a plurality of regions of said cleaning blade with respect to the widthwise direction;

a transfer member configured to transfer the toner image from said image bearing member onto a toner image receiving member;

an input portion configured to be inputted with the pressure information; and an executing portion configured to execute a toner supplying operation for supplying toner to the cleaning portion using a toner image formed on said image bearing member, in a period other than a period in which the toner image is formed on said image bearing member, for each predetermined number of image forming operations, wherein on the basis of the pressure information inputted to said input portion, said executing portion sets amounts of the toner supplied to the respective regions in the toner supplying operation.

2. An image forming apparatus according to claim 1, wherein said executing portion sets the amounts of the toners supplied to the respective regions in the toner supplying operation so that the amount of the toner supplied to the region in which the contact pressure is a first contact pressure is smaller than the amount of the toner supplied to the region in which the contact pressure is a second contact pressure larger than the first contact pressure.

3. An image forming apparatus according to claim 1, wherein said executing portion sets the amounts of the toners by changing a length of the toner image with respect to the movement direction.

4. An image forming apparatus according to claim 1, wherein said executing portion sets the amounts of the toners by changing the toner amount per unit area of the toner image for supply.

5. An image forming apparatus according to claim 1, wherein said executing portion sets the amounts of the toners by changing a number of times of supply of the toner per predetermined number of image forming operations.

6. An image forming apparatus according to claim 1, wherein said information storing member is an indicating portion in which the pressure information is indicated, and wherein the pressure information is inputted to said input portion by an operation of an operator.

7. An image forming apparatus according to claim 1, wherein said information storing member is a storing medium in which the pressure information is stored, and wherein the pressure information read from said storing medium is inputted to said input portion.

8. An image forming apparatus according to claim 1, wherein said image bearing member is a photosensitive drum.

9. An image forming apparatus according to claim 1, wherein said cleaning blade is contacted to said image bearing member counterdirectionally to the movement direction of said image bearing member.

10. An image forming apparatus comprising:

a plurality of units each configured to be detachably mountable to a main assembly of said image forming apparatus, each unit including:

an image bearing member configured to bear a toner image, an image bearing member cleaning blade contacting said respective image bearing member at a respective image bearing member cleaning portion and configured to remove deposited matter on said respective image bearing member with movement of said respective image bearing member, and an information storing member configured to store pressure information measured during an assembling step of said respective unit, the pressure information being information on contact pressures of said respective image bearing member cleaning blade to said respective image bearing member with respect to a widthwise direction perpendicular to a movement direction of said respective image bearing member in each of a plurality of regions of said respective image bearing member cleaning blade with respect to the widthwise direction;

an intermediary transfer member onto which the respective toner image is transferred from each of said image bearing members;

an input portion configured to be inputted with the pressure information;

an intermediary transfer member cleaning blade contacting said intermediary transfer member at an intermediary transfer cleaning portion and configured to remove deposited matter on said intermediary transfer member with movement of said intermediary transfer member; and an executing portion configured to execute a toner supplying operation in which a toner image for supply is formed on at least one of said image bearing members in a period other than a period in which the toner image is formed on said image bearing member and is transferred onto said intermediary transfer member and then toner of the toner image for supply is supplied to the intermediary transfer member, wherein on the basis of the pressure information inputted to said input portion, said executing portion determines said image bearing member on which the toner image for supply is to be formed and the region in which the toner image for supply is to be formed on the determined image bearing member and then sets a toner amount per predetermined number of image forming operations on the determined image bearing member of toner supplied to the determined region.

11. An image forming apparatus according to claim 10, wherein said executing portion sets the toner amount of each of the toner images for supply on the basis of relative comparison of the pressure information inputted to said input portion.

12. An image forming apparatus according to claim 10, wherein said executing portion sets the toner amount by changing a number of times of supply of the toner image for supply per predetermined number of image forming operations.

13. An image forming apparatus according to claim 10, wherein said executing portion sets the toner amount by changing a density of the toner image for supply.

14. An image forming apparatus according to claim 10, wherein said executing portion sets the toner amount by changing a length of the toner image for supply with respect to the widthwise direction.

15. An image forming apparatus according to claim 10, wherein each of said image bearing members is a photosensitive drum.

16. An image forming apparatus according to claim 10, wherein said intermediary transfer member is an intermediary transfer belt.

* * * * *